US006359275B1

(12) United States Patent
Bertsch et al.

(10) Patent No.: US 6,359,275 B1
(45) Date of Patent: Mar. 19, 2002

(54) DIELECTRIC CONDUIT WITH END ELECTRODES

(75) Inventors: James L. Bertsch, Palo Alto; Steven M. Fischer, Hayward; Julie B. Riccomini, Saratoga, all of CA (US)

(73) Assignee: Agilent Technologies, Inc., Palo Alto, CA (US)

( * ) Notice: Subject to any disclaimer, the term of this patent is extended or adjusted under 35 U.S.C. 154(b) by 0 days.

(21) Appl. No.: 09/352,467

(22) Filed: Jul. 14, 1999

(51) Int. Cl.[7] ..... H01J 49/04

(52) U.S. Cl. ..... 250/281; 250/288; 250/282; 250/423 R

(58) Field of Search ..... 250/288, 281, 250/282, 423 R

(56) References Cited

U.S. PATENT DOCUMENTS

| | | | | |
|---|---|---|---|---|
| 4,542,293 A | | 9/1985 | Fenn et al. | 250/288 |
| 5,726,447 A | | 3/1998 | Aisawa et al. | 250/288 |
| 5,736,740 A | | 4/1998 | Franzen | 250/288 |
| 5,736,741 A | | 4/1998 | Bertsch et al. | 250/288 |
| 5,838,003 A | | 11/1998 | Bertsch et al. | 250/288 A |
| 5,965,883 A | | 10/1999 | Lee et al. | 250/288 |
| 6,207,955 B1 | * | 3/2001 | Wells et al. | 250/288 |

OTHER PUBLICATIONS

Halaby, S.A. et al., "Materials of Thin–Film Devices", Electro–Technology, vol. 72, pp. 95–122d, Sep. 1963.

Lin, B. et al., "Ion Transport by Viscous Gas Flow Through Capillaries", J. Am. Soc. Mass Spectrom, vol. 5, pp. 873–885, 1994.

"The HP 4500 ICP–MS", Hewlett–Packard Company Manual, 1994.

* cited by examiner

*Primary Examiner*—Bruce Anderson
*Assistant Examiner*—Nikita Wells

(57) ABSTRACT

A conduit for conducting ions from a high pressure ion source to a mass analyzer in mass spectrometry apparatus includes a capillary tube in which the lumenal surface of the bore near at least one end is a surface of an electrically conductive material. In one embodiment the conduit is constructed of a dielectric material and has an electrically conductive coating on an end portion of the lumenal surface.

40 Claims, 3 Drawing Sheets

DIELECTRIC CONDUIT WITH END ELECTRODES

FIELD OF THE INVENTION

This invention relates to mass spectrometry and, particularly, to a conduit for conducting ions from a high-pressure ion source to a mass analyzer in mass spectrometry apparatus.

BACKGROUND

In mass spectrometry apparatus, an interface must be provided between a source of ions to be analyzed, which is typically at high-pressure (typically about atmospheric pressure), and the enclosure for the mass analyzer, which is typically at very low pressure. In one approach, a tube, having a bore usually of capillary dimension, serves as a conduit for the ions. The capillary is conventionally constructed of a dielectric material such as a glass and is provided at the ends with electrodes which are connected with sources of electrical potential.

A variety of techniques have been proposed for providing the electrodes. In one approach the ends of the tubing are painted with a metal such as platinum. Platinum adheres poorly to the glass, however, and because it is soft it wears poorly. To improve the wear properties, the platinum may be overcoated with nickel, but layers of nickel that are sufficiently thick to resist peeling can fracture or flake at higher operating temperatures, owing at least in part to differential thermal expansion.

SUMMARY

Generally, gas entering the upstream end of the conduit is in a turbulent flow condition for some distance, resulting in collisions of ions onto the lumenal surface. Because the conduit is constructed of a dielectric material, it is unable to carry away the electrical charge near the end of the conduit, and an undesirable charging effect results. Apparently, once laminar flow conditions are reached in the bore of the conduit, further downstream, ion collisions with the lumenal surface are substantially diminished, and charging effects are reduced. We have discovered that end-charging within the bore of the conduit can be reduced by coating the lumenal surface of an end portion of the tube with an electrically conductive material that carries away electrical charge resulting from ion collisions with the lumenal surface.

Accordingly, in one general aspect the invention features a conduit for conducting ions from a high pressure ion source to a mass analyzer in mass spectrometry apparatus, constructed of a dielectric material and having an electrically conductive coating on an end portion of the lumenal surface. In some embodiments the coating extends axially into the bore to the point at which, when the apparatus is in use, the flow of gas within the bore becomes laminar.

The end portions of the conduit are provided on at least the exterior surface with an electrically-conductive material serving as a contact for connection of the ends of the conduit to sources of electrical potential. Conveniently, the coating on the lumenal surface can be in electrical contact with the exterior contact.

In some embodiments a portion of the lumenal surfaces in at least one end of the conduit is coated with the electrically conductive material and, in some embodiments the two ends are similarly treated so that the conduit may be installed in the mass spectroscopy apparatus with either end oriented upstream. Between the end portions the conduit is nonconductive, for example by having no electrically-conductive material applied to the exterior and lumenal surfaces, over a length sufficient to permit the maintenance of the desired end-to-end potential.

In another general aspect the invention features a conduit for conducting ions from a high pressure ion source to a mass analyzer in mass spectrometry apparatus, which includes a tube constructed of a dielectric material and defining a capillary bore extending from end to end and having, affixed to at least one end of the capillary tube, an endpiece defining a bore having an electrically conductive lumenal surface and contiguous with the lumenal surface of the capillary tube at that end. Conveniently, the endpiece may also have an electrically conductive outer surface so that the outer surface of the endpiece provides an exterior contact for connection of the ends of the conduit to a source of electrical potential. In some embodiments the entire endpiece is constructed of an electrically conductive material, which may additionally be coated to provide good wear characteristics as well as electrical conductivity. Also conveniently, the endpiece can be configured as a short tube having dimensions similar to those of the dielectric tube. There may be an endpiece affixed to both ends of the dielectric tube and, conveniently, they may be similarly constructed so that the conduit may be installed with either end oriented upstream.

In some embodiments the desired end-to-end potential is in the range 500 V to 8 kV, or in some embodiments in the range 500 V to 5 kV. Usually the resistivity of the nonconducting portion of the conduit will be sufficiently high so that the current flow from end to end does not impracticably drain the power supply. In the interest of reducing current drain from the power source for the end-to-end potential, the nonconducting portion of the conduit will be longer where the conduit is made from a less poorly conductive dielectric, and can be shorter for less conductive dielectrics. For example, where a power supply is capable of delivering a maximum current of 1 mA at 5 kV, then the resistivity of the nonconducting portion of the conduit must be at least 5 MΩ. Power supplies in conventional use for this purpose typically furnish 1 mA or less, and for use with such power supplies the nonconducting portion of the conduit should have a resistivity at least 10 MΩ. In some embodiments the resistivity of the nonconductive portion of the conduit is less than 10 MΩ per cm, usually within the range 1 MΩ and 10 MΩ per cm. Depending upon the length and the current drain specification, the overall resistivity is usually in the range 10 MΩ–100 MΩ. Some glass materials, for example, require a conduit length about 1 cm/kV between electrically conductive end portions, so that the length of the nonconductive portion of the conduit should be as great as about 8 cm to maintain an end-to-end potential difference of 8 kV, for example. Such end-to-end potentials may be held over somewhat shorter lengths where a better dielectric material, such as a quartz or a ceramic, is used.

In some embodiments the coated portion within the bore extends from the end to a distance at least five times the bore diameter, more usually at least ten times the bore diameter.

In some embodiments the film or coating on the lumenal surface is generally thicker at the end, and thinner extending from the end within the lumen; and in some embodiments the coating provides more thorough continuity near the end than farther inward. In such embodiments the coating thickness can be said to taper within the lumen from a finite thickness near the end to substantially no thickness at some point inward, or the coating can be said to be attenuated inwardly progressively to substantially no thickness. The result of the taper or attenuation of the coating is a progressive reduction of conductivity, so that the conductivity of the coating or film at its innermost limit approaches that of the lumenal surface of the dielectric wall material.

In some embodiments the dielectric material of which the conduit is constructed is a glass or a quartz or a ceramic or a plastic such as a polytetrafluoroethylene ("PTFE", Teflon®) or a polyimid (Vespel®).

In some embodiments the electrically conductive material is a relatively nonreactive electrically conductive metal such as, for example, chromium or silver or gold or platinum. In some embodiments an additional electrically conductive coating is applied onto the surface of a portion of the electrically conductive coating and in conductive relation to it, usually onto the exterior portion, to provide mechanical and other properties not provided by the first-applied electrically conductive material.

In another general aspect the invention features a method for making an end-coated conduit for conducting ions from a high pressure ion source to a mass analyzer in mass spectrometry apparatus, by providing a tube made of a dielectric material and having suitable dimensions with an electrically conductive material, and applying a coating onto a portion of the exterior surface and onto a portion of the lumenal surface of an end of the tube.

In some embodiments the coating is applied by conventional sputter coating or vapor coating. The end of the conduit is presented to the source of coating material during the coating process in such a way that some coating material is directed into the opening of the bore of the conduit at the end and is deposited onto the lumenal surface there. In some embodiments the coating is applied by electrodeless plating.

In some embodiments the coating is applied by conventional chemical deposition techniques, using for example a ceramic paint or a metal paint such as a gold paint or silver paint, or, for example, a chrome hexacarbonate.

In another general aspect the invention features an end-coated conduit for providing an interface for conducting ions from a high-pressure ion source to a mass analyzer in mass spectrometry apparatus, made by the method of the invention.

DETAILED DESCRIPTION

Particular embodiments will now be described in detail with reference to the drawings, in which like parts are referenced by like numerals. The drawings are not to scale and, in particular, certain of the dimensions such as for example the thicknesses of films or coatings, are exaggerated for clarity of presentation.

Figure 1:
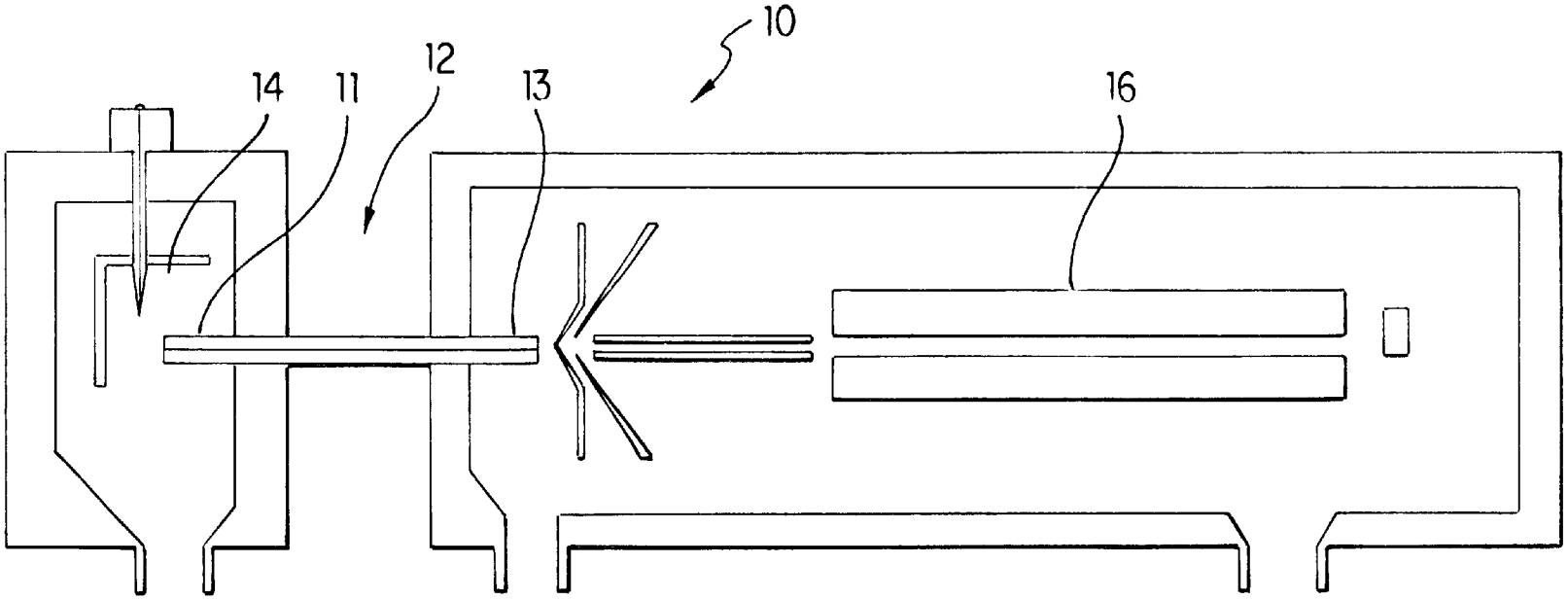
FIG. 1 is a diagrammatic sketch in a sectional view showing an embodiment of a conduit according to the invention, in the form of an end-coated capillary, installed in mass spectrometry apparatus.

Referring now to the drawings, there is shown in FIG. 1 by way of example generally at 12 an embodiment of the conduit according to the invention, installed in mass spectroscopy apparatus shown generally at 10. The conduit provides an interface between a higher-pressure ion source such as an electrospray ion source 14, and a mass analyzer such as a quadrupole mass analyzer 16. As will be appreciated, the conduit according to the invention may be employed as an interface between other kinds of ion sources than electrospray, such as for example plasma, including inductively coupled plasma ("ICP"), other elevated pressure sources, and other sources; and other kinds of mass analyzers, such as for example ion trap, time-of-flight, magnetic sector, Fourier transform ion cyclotron resonance ("FTICR") mass analyzers, and others. An outer surface of a segment of each end of the conduit, end 11 upstream and end 13 downstream, is capped with an electrically conductive material to provide connections to a source of electrical potential.

Figure 2:
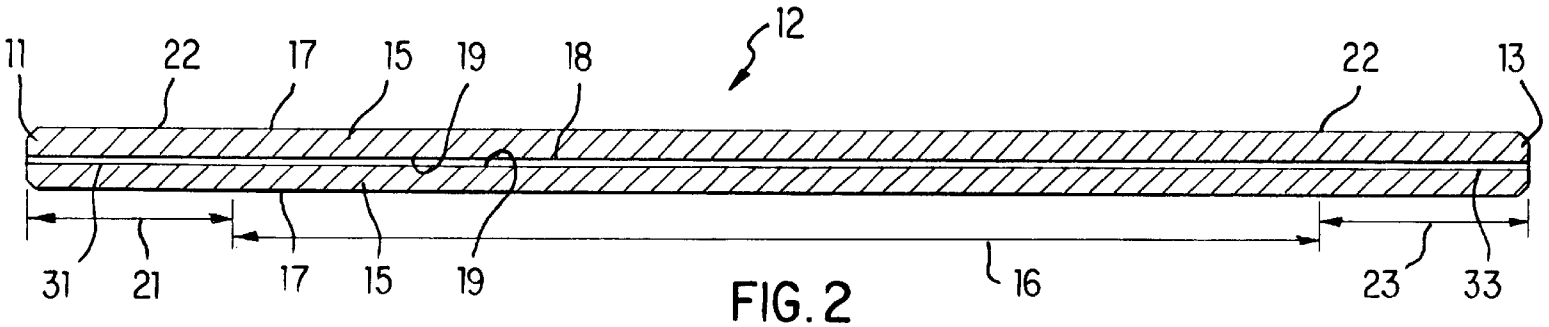
FIG. 2 is a sketch in a sectional view along the axis of an exemplary embodiment of an end-coated capillary conduit according to the invention.

A particular embodiment of the conduit 12 of the invention is shown in greater detail in FIG. 2. Conduit 12 is a tube having a wall 15 of a dielectric material, such as a glass or a quartz or a ceramic or a plastic, defining an external surface 17, and a lumenal surface 19 defining an axial bore 18. Conduit 12 has a first end 11 and a second end 13, defining also the ends of the bore 18 and of the external and lumenal surfaces 17 and 19. In the embodiment shown here both ends 11 and 13 are similarly coated with conductive material, as will now be described with reference to FIGS. 2, 3 and 4.

Each end of conduit 12 is coated over a portion 21 of the external surface 17 near end 11 and over a portion 23 of the external surface 17 near end 13 with an electrically conductive material 22. Between the coated portions a length 16 of the wall 15 is left uncoated. Additionally, each wall end 11 and 13 of conduit 12 is coated, and a portion 31 of the lumenal surface 19 of the wall near end 11 and a portion 33 of the lumenal surface 19 of the wall near end 13 are coated with an electrically conductive material 32. In the embodiment shown here, an additional coating 34 of an electrically conductive material is applied onto the surface of the first-applied conductive material 32, in such a manner that the first-applied material 32 and the additional coating 34 are in electrically conductive relation. In this embodiment the outer layer can be applied onto the lumenal surface of the first layer as well, as well as on the end and the external surface. Accordingly, where the first applied material is chromium, and where an additional coating of gold is employed, the gold may be applied only onto the end and the external chromium-coated surface, or additionally onto the lumenal chromium-coated surface as well. In practice, depending on whether the same process is employed to apply both coatings, the gold may be applied wherever the chromium has been applied.

Figure 4:
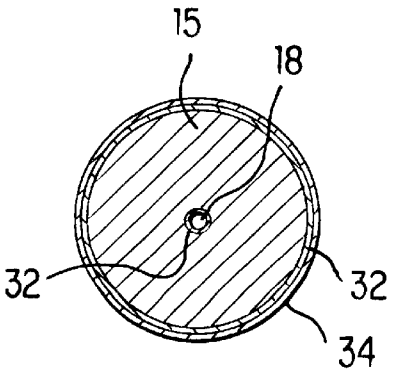
FIG. 4 is a sketch of the embodiment shown in FIGS. 2 and 3, in transverse sectional view thru 4–4' in FIG. 3.
Figure 3:
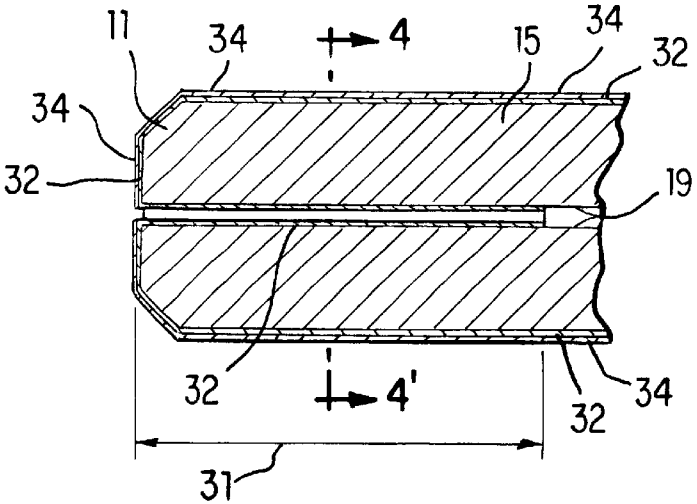
FIG. 3 is a detail from the sketch of FIG. 2 showing details of an end of the embodiment of the end-coated capillary conduit according to the invention.

Prototypes were constructed generally as shown in FIGS. 2, 3 and 4 using conventional sputter coating apparatus as follows. (For a general discussion of conventional sputter coating, see, e.g., *Electro-Technology* (September 1963), Vol. 72, pages 95 et seq.) Glass tubing, Pyrex 7740, having an outside diameter about 6.5 mm and an inside diameter about 0.5 mm was cut to length about 18 cm and the ends were beveled and flame polished. The bore was rendered free of chemical residue by HCl wash (principally for removal of trace metals) followed by an oxygen plasma (for removal of organics). Then the tube was mounted in the sputter coating apparatus in a holder that permits the end to be presented to the source of metal at a selected angle, and rotated. First, chromium was applied by sputter coating to a thickness on the external surface and the end surface of about 1.5 micrometers. Each end was presented to the source of chromium in the sputter coating apparatus in such a manner that chromium was directed onto the external surface and onto the end surface and into the opening of the bore and deposited onto the lumenal surface. The coating on the external surface extended for a distance about 25 mm from each end. This limit was established by masking, by enclosing the capillary within a second slightly larger tube; other approaches to limiting the extent of coating could be employed. The thickness of the chromium coating on the lumenal surface was about 1.5 $\mu$m near the opening, and gradually thinning within the bore to the point that it was no longer visible on inspection, about 1 mm to 10 mm from the end of the bore. Electrical continuity was established between the lumenal surface and the external surface through the end coating. Then gold was applied over the chromium coating in a similar manner by sputter coating to a thickness on the external surface of about 0.5 $\mu$m.

The first-applied chromium coating and gold top coating applied in this manner are suitably electrically conductive; the chromium coating adheres well to the surface of the glass and the gold top coating adheres well to the chromium coating under conditions of repeated installation, cleaning and use; and the gold top coating provides good wearability and appearance.

Prototypes made as described above were tested by installing the device in a mass spectrometry system employing a conventional electrospray ion source particularly, the Hewlett-Packard 1100 LC-MSD) and running samples of known composition. The capillaries according to the invention showed substantially no charging effect at the upstream end, and significantly less charging than showed by use of Pyrex 7740 capillaries of the same dimensions, having conventional electrical contacts and no conductive material at the ends within the lumen.

Figure 5:
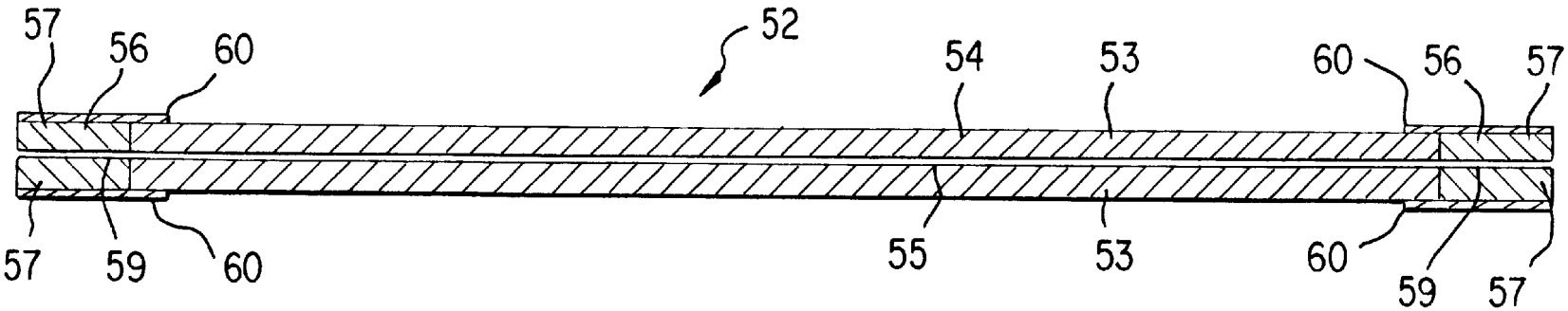
FIG. 5 is a sketch in a sectional view along the axis of an alternative embodiment of a conduit according to the invention, constructed as a capillary tube with electrically conductive endpieces.

An alternative embodiment of a conduit according to the invention is shown by way of example in FIG. 5. Here, the conduit 52 includes over most of its length a capillary tube 54 having a wall 53 of a dielectric material enclosing an axial bore 55 and, affixed to the ends of capillary tube 54, endpieces 56, each having a wall 57 of an electrically conductive material enclosing an axial bore 59. Axial bores 59 of endpieces 56 have diameters the same as or closely approximating the diameter of the axial bore 55 of the capillary 54 and the bores 55 and 59 are axially aligned. In this embodiment, the lumenal surface of the endpieces 56 provide an electrically conductive surface at the ends, and the lumenal surface of capillary tube 54 provides a nonconductive portion between. Because the endpieces are constructed of an electrically conductive material, their respective outer surfaces can provide contact for connection of the ends of the conduit to a source of electrical potential. The endpieces may be additionally coated on the external surface with an electrically conductive metal having good wear characteristics (such as, for example, gold), so that the bulk of the endpiece can be of a less costly material (such as, for example, a stainless steel alloy). Or, as is shown in FIG. 5, an electrically conductive sleeve 60 may be employed to provide contact, and where an electrically conductive sleeve 60 is employed, it may be constructed of (or coated with) a metal having good wear properties.

The endpiece may be attached to the capillary tube by any convenient means of attachment, including for example, application of an adhesive such as an epoxy at the juncture between the endpiece and the capillary. Preferably, the endpiece is constructed and attached so that there is a smooth junction between the bore of the endpiece and the bore of the capillary, so that gas flow within is not disrupted at that point.

In embodiments having endpieces, as shown for example in FIG. 5, the length of the bore of the endpiece provides the length of the electrically conductive lumenal end portion of the bore of the conduit, and the length of the bore of the capillary tube provides the length of the dielectric (nonconductive) portion of the conduit. Accordingly, the bore of the endpiece at the input end of the conduit will preferably be long enough so that as described above, when the apparatus is in use, the flow of gas within the bore becomes laminar at a point generally at or upstream from the point of attachment of the endpiece and the dielectric capillary tube. And, accordingly, the dielectric capillary tube should be long enough so that as described above, the desired end-to-end potential can be maintained without unacceptable loss owing to current flow.

Other embodiments are within the claims. For example, as described above, although contacts must be provided at both ends of the conduit for connection to a source of electrical potential, electrical conductivity within the lumenal surface is required according to the invention only in the end portion at the input (upstream) end of the conduit. Thus, for example, in embodiments having a film or coating of conductive material on the lumenal surface within an end portion of the bore, such treatment need not be carried out at both ends. Similarly, in embodiments employing an endpiece, endpieces need not be provided at both ends of the capillary tube, but where an endpiece is used at only one end, some provision will have to be made at the other end for electrical contact with a source of electrical potential.

Where an endpiece is employed, it may have any shape consistent with the desirability of having the bores of the endpiece and the capillary be axially arranged and of the same or nearly the same dimension. Conveniently, the endpiece has the shape of a short tubular segment, or bushing, having walls and bore dimensioned similarly to the walls and bore of the capillary. The endpiece may be constructed of a composite material, and the bulk of the endpiece need not be of an electrically conductive material, so long as the lumenal surface of the bore is electrically conductive over the desired length.

Similarly, the portion of the conduit enclosing the nonconductive lumenal surface may be of a composite material, including a laminate, so long the conduit provides sufficiently high resistivity between the ends, as described above, to maintain the desired end-to-end potential without unacceptable losses from current flow. Preferred materials for the dielectric portion of the conduit and for the endpiece, where such is employed, will preferably be selected to have similar mechanical properties (such as thermal expansion, for example), and to provide for good attachment.

Any of various materials may be used for the coating on the lumenal surface, including for example, gold, platinum, tin and tin compounds such as tin halides and tin oxides, silver and silver compounds such as silver halides and silver oxides, tungsten and tungsten halides such as tungsten chlorides, and titanium and titanium halides such as titanium chlorides.

What is claimed is:

1. A conduit for conducting ions from a high pressure ion source toward a mass analyzer, comprising:

(a) a tubular conduit wall of dielectric material with an external surface, a lumenal surface and a longitudinal axis;

(b) a first conduit end with a first opening; and (c) a second conduit end with a second opening opposite said first opening;

wherein at least a portion of said lumenal surface comprises an electrically conductive material for reducing end-charging and carrying away electrical charge resulting from ion collisions with said lumenal surface.

2. The conduit of claim 1, wherein a portion of said external surface at each end of said conduit comprises an electrically conductive material.

3. The conduit of claim 1, wherein said tubular conduit wall of dielectric material is selected from the group consisting of glass, quartz, ceramic and plastic.

4. The conduit of claim 1, wherein the entire lumenal surface of said conduit comprises said electrically conductive material.

5. The conduit of claim 1, wherein said electrically conductive material is a metal.

6. The conduit of claim 5, wherein said metal is selected from the group consisting of chromium, tungsten, tungsten halides, titanium, titanium halides, gold, platinum, tin, tin halides, tin oxides, silver, silver halides and silver oxides.

7. The conduit of claim 1, wherein said portion of the lumenal surface has a coating of said electrically conductive material.

8. The conduit of claim 7, wherein the thickness of said coating decreases from at least one conduit end.

9. A mass spectrometer comprising:

(a) an ion source;

(b) a mass analyzer downstream from said ion source; and (c) a conduit for conducting ions from said ion source toward said mass analyzer, comprising:

(i) a tubular wall of dielectric material with an external surface, a lumenal surface and a longitudinal axis;

(ii) a first conduit end with a first opening adjacent to said ion source; and (iii) a second conduit end with a second opening opposite said first opening;

wherein a portion of said lumenal surface comprises an electrically conductive material for reducing end-charging and carrying away electrical charge resulting from ion collisions with said lumenal surface.

10. The mass spectrometer of claim 9, wherein a portion of said external surface at each end of said conduit comprises said electrically conductive material.

11. The mass spectrometer of claim 9, wherein said tubular wall of dielectric material is selected from the group consisting of glass, quartz, ceramic and plastic.

12. The mass spectrometer of claim 9, wherein said electrically conductive lumenal surface material comprises a metal.

13. The mass spectrometer of claim 12, wherein said metal is selected from the group consisting of chromium, tungsten, tungsten halides, titanium, titanium halides, gold, platinum, tin, tin halides, tin oxides, silver, silver halides and silver oxides.

14. The mass spectrometer of claim 9, wherein said lumenal surface has a coating of said electrically conductive material.

15. The mass spectrometer of claim 14, wherein the thickness of said coating decreases from at least one conduit end.

16. A conduit comprising a tubular wall of dielectric material and a lumenal surface, a portion of said lumenal surface comprising an electrically conductive material for reducing end-charging and carrying away electrical charge resulting from ion collisions with said lumenal surface.

17. A method for reducing end charging on a lumenal surface of a dielectric conduit comprising applying an electrically conductive coating to a least a portion of said lumenal surface.

18. The method of claim 17, wherein said step of applying said coating comprises sputtering.

19. The method of claim 17, wherein said step of applying said coating comprises vapor deposition.

20. The method of claim 17, wherein said step of applying said coating comprises electrodeless plating.

21. A method for reducing end charging on a lumenal surface of a dielectric conduit comprising fabricating said lumenal surface of an electrically conductive material.

22. An end coated conduit made by the method of claims 17 or 21.

23. A method for reducing end charging in a dielectric conduit having an external surface and a lumenal surface, comprising:

(a) applying a first metal coating to a portion of each of said external surfaces and lumenal surfaces; and (b) establishing an electrical continuity between each of said first metal coatings on said surfaces.

24. A method as recited in claim 23, further comprising applying a second metal coating onto the first metal coatings.

25. The method of claim 23, wherein said step of applying a first metal coating comprises sputtering.

26. The method of claim 23, wherein said first metal coating comprises chromium.

27. The method of claim 24, wherein said step of applying a second coating comprises sputtering.

28. The method of claim 24, wherein said second metal coating comprises gold.

29. A mass spectrometer comprising:

(a) an ion source;

(b) a mass analyzer downstream from said ion source; and (c) a conduit for conducting ions of a gas from said ion source toward said mass analyzer, comprising:

(i) a tubular conduit wall of dielectric material with an external surface and a lumenal surface;

(ii) a conduit end with an opening; and (d) an end piece for attachment to said conduit end, comprising an electrically conductive material enclosing an axial bore with a lumenal surface, said lumenal surface of said end piece being aligned with said lumenal surface of said tubular conduit.

30. A conduit for conducting ions from a high pressure ion source toward a mass analyzer, comprising:

(a) a tubular conduit wall of dielectric material with an external surface and a lumenal surface;

(b) a conduit end with an opening; and (c) an end piece for attachment to said conduit end, comprising an electrically conductive material enclosing an axial bore with a lumenal surface, said lumenal surface of said end piece being aligned with said lumenal surface of said tubular conduit.

31. A mass spectrometer comprising:

(a) an ion source;

(b) a mass analyzer downstream from said ion source; and (c) a conduit for conducting ions of a gas from said ion source toward said mass analyzer, comprising:

(i) a tubular wall of dielectric material with an external surface, a lumenal surface and a longitudinal axis; a portion of said lumenal surface comprising an electrically conductive material extending into said conduit along said longitudinal axis to an extent such that the flow of gas within the conduit is laminar;

(ii) a first conduit end with a first opening adjacent to said ion source; and (iii) a second conduit end with a second opening opposite said first opening.

32. A conduit for conducting ions from a high pressure ion source toward a mass analyzer, comprising:

(a) a tubular conduit wall of a dielectric material with an external surface, a lumenal surface and a longitudinal axis; a portion of said lumenal surface comprising an electrically conductive material extending into said conduit along said longitudinal axis to an extent such that the flow of gas within said conduit is laminar;

(b) a first conduit end with a first opening; and (c) a second conduit end with a second opening opposite said first opening.

33. A mass spectrometer comprising:

(a) an ion source;

(b) a mass analyzer downstream from said ion source; and (c) a conduit for conducting ions of a gas from said ion source toward said mass analyzer, comprising:

(i) a tubular conduit wall of dielectric material with an external surface, a lumenal surface and a longitudinal axis;

(ii) a first conduit end with a first opening adjacent to said ion source; and (iii) a second conduit end with a second opening opposite said first opening;

wherein said lumenal surface has an electrically conductive material extending from said first conduit end into said conduit along said longitudinal axis to at least five times the conduits diameter.

34. A conduit for conducting ions from a high pressure ion source toward a mass analyzer, comprising:

(a) a tubular conduit wall of dielectric material with an external surface, a lumenal surface and a longitudinal axis;

(b) a first conduit end with a first opening adjacent to said ion source; and (c) a second conduit end with a second opening opposite said first opening;

wherein said lumenal surface has an electrically conductive material extending from said first conduit end into said conduit along said longitudinal axis to at least five times the conduits diameter.

35. A mass spectrometer comprising:

(a) an ion source;

(b) a mass analyzer downstream from said ion source; and (c) a conduit for conducting ions of a gas from said ion source toward said mass analyzer, comprising:

(i) a tubular conduit wall of dielectric material with an external surface, a lumenal surface and a longitudinal axis;

(ii) a first conduit end with a first opening adjacent to said ion source; and (iii) a second conduit end with a second opening opposite said first opening;

wherein said lumenal surface has an electrically conductive material extending from said first conduit end into said conduit along said longitudinal axis to at least ten times the conduits diameter.

36. A conduit for conducting ions from a high pressure ion source toward a mass analyzer, comprising:

(a) a tubular conduit wall of dielectric material with an external surface, a lumenal surface and a longitudinal axis;

(b) a first conduit end with a first opening adjacent to said ion source; and (c) a second conduit end with a second opening opposite said first opening; wherein said lumenal surface has an electrically conductive material extending from said first conduit end into said conduit along said longitudinal axis to at least ten times the conduits diameter.

37. A mass spectrometer comprising:

(a) an ion source;

(b) a mass analyzer downstream from said ion source; and (c) a conduit for conducting ions of a gas from said ion source toward said mass analyzer, comprising:

(i) a tubular conduit wall of dielectric material with an external surface, a lumenal surface and a longitudinal axis; said lumenal surface having an electrically conductive coating extending into said conduit along said longitudinal axis to at least five times the conduits diameter;

(ii) a first conduit end with a first opening adjacent to said ion source; and (iii) a second conduit end with a second opening opposite said first opening.

38. A conduit for conducting ions from a high pressure ion source toward a mass analyzer, comprising:

(a) a tubular conduit wall with an external surface, a lumenal surface and a longitudinal axis; said lumenal surface having an electrically conductive coating extending into said conduit along said longitudinal axis to at least five times the conduits diameter;

(b) a first conduit end with a first opening; and (c) a second conduit end with a second opening opposite said first opening.

39. A mass spectrometer comprising:

(a) an ion source;

(b) a mass analyzer downstream from said ion source; and (c) a conduit for conducting ions of a gas from said ion source toward said mass analyzer, comprising:

(i) a tubular conduit wall of dielectric material with an external surface, a lumenal surface and a longitudinal axis;

(ii) a first conduit end with a first opening adjacent to said ion source; and (iii) a second conduit end with a second opening opposite said first opening;

wherein said lumenal surface has an electrically conductive coating extending from said first conduit end into said conduit along said longitudinal axis.

40. A conduit for conducting ions from a high pressure ion source toward a mass analyzer, comprising:

(a) a tubular conduit wall of dielectric material with an external surface, a lumenal surface and a longitudinal axis;

(b) a first conduit end with a first opening adjacent to said ion source; and (c) a second conduit end with a second opening opposite said first opening;

wherein said lumenal surface has an electrically conductive coating extending from said first conduit end into said conduit along said longitudinal axis.

* * * * *